US008381823B2

(12) United States Patent
Swietlik et al.

(10) Patent No.: US 8,381,823 B2
(45) Date of Patent: Feb. 26, 2013

(54) DOWNHOLE TUBULAR CONNECTOR

(75) Inventors: George Swietlik, Lowestoft (GB); Robert Large, Lowestoft (GB)

(73) Assignee: Pilot Drilling Control Limited, Lowestoft, Suffolk (GB)

( * ) Notice: Subject to any disclaimer, the term of this patent is extended or adjusted under 35 U.S.C. 154(b) by 462 days.

(21) Appl. No.: 12/703,123

(22) Filed: Feb. 9, 2010

(65) Prior Publication Data

US 2010/0206583 A1 Aug. 19, 2010

Related U.S. Application Data

(63) Continuation-in-part of application No. 12/368,199, filed on Feb. 9, 2009, now Pat. No. 8,002,028, which is a continuation-in-part of application No. 11/703,915, filed on Feb. 8, 2007, now Pat. No. 7,690,422, application No. 12/703,123, which is a continuation-in-part of application No. PCT/GB2009/000338, filed on Feb. 9, 2009.

(30) Foreign Application Priority Data

| | | |
|---|---|---|
| Feb. 8, 2006 | (GB) | 0602565.4 |
| Feb. 8, 2008 | (GB) | 0802406.9 |
| Feb. 8, 2008 | (GB) | 0802407.7 |
| Mar. 20, 2008 | (GB) | 0805299.5 |

(51) Int. Cl.
*E21B 23/00* (2006.01)

(52) U.S. Cl. ..... 166/381; 166/242.6; 166/242.7; 166/380; 166/387

(58) Field of Classification Search ..... 166/242.7, 166/380, 381, 387, 242.6
See application file for complete search history.

(56) References Cited

U.S. PATENT DOCUMENTS

| | | | | |
|---|---|---|---|---|
| 2,313,263 | A * | 3/1943 | Rea | 294/86.31 |
| 2,659,440 | A * | 11/1953 | Osmun | 285/3 |
| 3,374,841 | A | 3/1968 | Current | |
| 3,874,634 | A | 4/1975 | Gazda | |
| 4,224,987 | A * | 9/1980 | Allen | 166/120 |
| 4,377,179 | A | 3/1983 | Giebeler | |
| 4,495,073 | A | 1/1985 | Beimgraben | |
| 5,033,551 | A * | 7/1991 | Grantom | 166/387 |
| 5,133,419 | A | 7/1992 | Barrington | |
| 5,518,072 | A * | 5/1996 | McTernaghan | 166/115 |
| 5,609,205 | A | 3/1997 | Massie et al. | |

(Continued)

FOREIGN PATENT DOCUMENTS

| | | |
|---|---|---|
| CA | 2577542 A1 | 8/2007 |
| EP | 1019614 A1 | 7/2000 |

(Continued)

OTHER PUBLICATIONS

Office Action in U.S. Appl. No. 12/368,217; dated Nov. 24, 2010 (18 pages).

(Continued)

*Primary Examiner* — Giovanna Wright
(74) *Attorney, Agent, or Firm* — Osha Liang LLP

(57) ABSTRACT

A downhole tubular connector comprising a first body portion and a seal provided on the first body portion, the seal being adapted to selectively provide a seal with a downhole tubular, the downhole tubular connector further comprises a seal protector, wherein one of the seal protector and seal is movable with respect to the other of the seal protector and seal, the seal protector or seal being movable from a first position, in which at least a portion of the seal is protected by a first end of the seal protector, to a second position, in which the portion of the seal is exposed. The seal protector may be disposed so as to be movable from the first position to the second position by contact of the sleeve with the downhole tubular as the downhole tubular connector is brought into engagement with the downhole tubular.

19 Claims, 9 Drawing Sheets

U.S. PATENT DOCUMENTS

| | | | | |
|---|---|---|---|---|
| 5,735,348 | A | 4/1998 | Hawkins, III | |
| 6,390,190 | B2 | 5/2002 | Mullins | |
| 6,390,198 | B2 * | 5/2002 | Brooks et al. | 166/313 |
| 7,690,422 | B2 | 4/2010 | Swietlik et al. | |
| 2002/0129934 | A1 | 9/2002 | Mullins et al. | |
| 2006/0196673 | A1 * | 9/2006 | Pallini et al. | 166/368 |
| 2007/0181346 | A1 | 8/2007 | Swietlik et al. | |
| 2009/0200038 | A1 | 8/2009 | Swietlik et al. | |
| 2009/0205386 | A1 | 8/2009 | Irie et al. | |
| 2009/0205827 | A1 | 8/2009 | Swietlik et al. | |
| 2009/0205837 | A1 | 8/2009 | Swietlik et al. | |

FOREIGN PATENT DOCUMENTS

| | | | |
|---|---|---|---|
| EP | 1632640 | | 3/2006 |
| FR | 0700899 | A | 3/1931 |
| GB | 2074634 | A | 11/1981 |
| GB | 2435059 | A | 8/2007 |
| GB | 2457287 | A | 8/2009 |
| GB | 2457288 | A | 8/2009 |
| GB | 2457317 | A | 8/2009 |
| WO | 9307358 | | 4/1993 |
| WO | 0019060 | | 4/2000 |
| WO | 2005090740 | | 9/2005 |
| WO | 2009098473 | A2 | 8/2009 |
| WO | 2009098474 | A1 | 8/2009 |
| WO | 2009098478 | A2 | 8/2009 |
| WO | 2009098482 | A1 | 8/2009 |

OTHER PUBLICATIONS

Office Action in U.S. Appl. No. 12/368,161, dated Oct. 21, 2010 (26 pages).

Office Action in U.S. Appl. No. 12/368,199, dated Dec. 21, 2010 (24 pages).

International Search Report for Patent Application No. PCT/GB2010/000229, dated Apr. 6, 2010 (14 pages).

International Search Report for Patent Application No. PCT/GB2010/000230, dated Apr. 6, 2010 (14 pages).

Office Action in U.S. Appl. No. 12/368,187; dated Feb. 16, 2011 (27 pages).

Notice of Allowance in U.S. Appl. No. 12/368,199; dated Apr. 29, 2011 (9 pages).

Notice of Allowance in U.S. Appl. No. 12/368,217; dated May 11, 2011 (13 pages).

Office Action for U.S. Appl. No. 12/703,129 mailed Apr. 27, 2012 (16 pages).

* cited by examiner

DOWNHOLE TUBULAR CONNECTOR

CROSS-REFERENCE TO RELATED APPLICATION

The present application claims priority as a continuation-in-part, pursuant to 35 U.S.C. §119(e), to the filing dates of U.S. patent application Ser. No. 12/368,199, and PCT Patent Application No. PCT/GB2009/000338, both filed on Feb. 9, 2009, which are hereby incorporated by reference in their entirety.

BACKGROUND OF DISCLOSURE

1. Field of the Disclosure

This disclosure relates to a connector and particularly but not exclusively relates to a connector for a downhole tubular.

2. Background Art

GB2435059 discloses a connector for selectively connecting a top drive assembly to a downhole tubular, for example a drill string or casing string. (GB2435059, GB2457287, GB2457288, GB2457317, WO2009/098482, WO2009/098478, WO2009/098473, WO2009/098474, US20070181346A1, US20090200038A1, US2009205827A1, US2009205836A1, US2009205837A1, FR0700899 and CA2577542 are incorporated herein by reference.) One embodiment of a connector disclosed therein comprises an extendable portion with a seal disposed at a distal end of the extendable portion. The seal may engage with the downhole tubular when the extendable portion is extended, thereby greatly reducing the time to fluidically connect and disconnect the downhole tubular from the top drive assembly. The seal may, for example, but not limited to, comprise a cup seal or an inflatable seal and the seal may be adapted for placement within the bore of a downhole tubular, e.g., the seal may contact the inner wall of the downhole tubular.

In the case of a downhole tubular 2 with a tapered box connection 4, as shown in FIG. 1*a*, the seal may be at least partially guided into the bore 6 of the downhole tubular by the tapered box connection, e.g., contact the inner threaded wall of the box connection. As illustrated with a downhole tubular 12 with a double shouldered box connection 14 in FIG. 1*b*, a seal may impinge on an internal shoulder 18 (e.g., a shoulder perpendicular to the longitudinal axis of the connection) between a threaded portion 20 and the bore 16 of the downhole tubular 12. Such an impingement of a seal on an internal shoulder (e.g., 18 in FIG. 1*b*) and/or contact with the inner threaded wall of a box connection (e.g., in FIG. 1*a* or 1*b*) may damage and/or increases the wear rate of the seal, thereby reducing its life and increasing the risk of a seal failure. Furthermore, the impingement may also prevent the seal from being disposed (e.g., landing) in the bore 16 altogether.

The present disclosure therefore seeks to address these issues.

SUMMARY OF INVENTION

According to a first aspect of the present disclosure there is provided a downhole tubular connector comprising a seal adapted to selectively seal the downhole tubular connector with a downhole tubular, the downhole tubular connector further comprising a seal protector adapted to selectively protect the seal, the seal protector and seal being arrangeable, e.g. movable, with respect to one another such that in a first position at least a portion of the seal is covered by the seal protector, and in a second position the portion of the seal is exposed.

According to a second aspect of the present disclosure there is provided a downhole tubular connector comprising a first body portion and a seal provided on the first body portion, the seal being adapted to selectively provide a seal with a downhole tubular, the downhole tubular connector further comprises a seal protector, wherein one of the seal protector and seal is movable with respect to the other of the seal protector and seal, the seal protector or seal being movable from a first position, in which at least a portion of the seal is protected by a first end of the seal protector, to a second position, in which the portion of the seal is exposed.

The seal protector may be movable from the first position to the second position by virtue of an interaction (e.g., contact) of the seal protector with the downhole tubular. In other words, the seal protector may move with respect to the seal in order to reveal the seal. The interaction may occur as the downhole tubular connector is brought into engagement with the downhole tubular.

The seal protector may comprise a sleeve. The seal protector may be slidably disposed relative to the first body portion.

The downhole tubular connector may further comprise a resilient element disposed so as to bias the seal protector into the first position. The resilient element may comprise a spring.

The seal protector may comprise a shoulder. The resilient element may engage the shoulder. The shoulder may be internal with respect to the remainder of the seal protector. The resilient element may be at least partially guided within a second end of the seal protector. The shoulder may be disposed so as to slidably engage with the first body portion. The second end of the seal protector may at least partially surround the resilient element to resist lateral movement of the resilient element. For example, when the resilient element, e.g. a spring, may be compressed, there may be a tendency for the resilient element to buckle in a lateral direction. Such lateral movement may reduce the effectiveness of the resilient element and the second end of the seal protector may prevent this from occurring.

The downhole tubular connector may comprise a first abutment surface disposed so as to limit movement of the seal protector beyond the first position. The downhole tubular connector may comprise a second abutment surface disposed so as to limit movement of the seal protector beyond the second position.

The seal protector may be configured to engage a shoulder (e.g., an abutment shoulder) within the downhole tubular, for example a box connection shoulder. Alternatively, the seal protector may be configured to engage a shoulder at the topmost end of the downhole tubular, for example an external end face of a box connection or a pin connection (for example in the case of a string of downhole tubulars with upwardly facing pin connections). The seal may be adapted to selectively fit inside and seal against an internal bore of the downhole tubular. The seal may be adapted to selectively fit inside and seal against a portion of the bore of the downhole tubular below a box connection, e.g., seal against the tubular bore wall and not in the bore of the box connection. The seal may be resilient and may for example be made of rubber. The seal may comprise a cup seal.

The downhole tubular connector may further comprise a second body portion. The first body portion may be extendable with respect to the second body portion. The seal protector may be connected to the second body portion. In other words, the seal may move with respect to the seal protector in order to reveal the seal. The seal protector may be arranged so as to centralise the downhole tubular connector with respect to the downhole tubular. The seal protector may be configured to selectively engage a portion of the downhole tubular and to centralise, e.g., substantially centralise, the longitudinal axis of the downhole tubular connector with respect to the longitudinal axis of the bore of the downhole tubular.

The second body portion may be in fluid communication with a flow source, for example a top drive assembly. The downhole tubular connector may permit fluid to selectively flow from the fluid source through the second and first body portions and into the bore of the downhole tubular.

The seal protector may comprise a threaded portion. The threaded portion may be adapted to engage a corresponding thread on the downhole tubular. The threaded portion may be provided on an inner or an outer surface of the seal protector and accordingly may engage an outer or an inner thread on the downhole tubular respectively.

The downhole tubular connector may further comprise a centralising member provided on a distal end of the first body portion. The centralising member may be disposed to centralise the downhole tubular connector with respect to a bore of the downhole tubular as the downhole tubular connector is brought into engagement with the downhole tubular.

The first body portion may comprise a bore adapted to transfer fluids to or from the downhole tubular. The downhole tubular connector may be adapted to selectively connect a top drive assembly to the downhole tubular.

According to a third aspect of the present disclosure there is provided a method of sealing a downhole tubular connector with a downhole tubular, the method comprising: providing the downhole tubular connector with a first body portion and a seal provided on the first body portion, the seal being adapted to selectively provide a seal with the downhole tubular; further providing the downhole tubular connector with a seal protector, wherein one of the seal protector and seal is movable with respect to the other of the seal protector and seal, moving the seal protector or seal from a first position, in which at least a portion of the seal is covered by a first end of the seal protector, to a second position, in which the portion of the seal is exposed; and sealing the seal against the downhole tubular.

According to a fourth aspect of the present disclosure there is provided a method of sealing a downhole tubular connector with a downhole tubular, the method comprising: providing the downhole tubular connector with a seal adapted to selectively seal the downhole tubular connector with the downhole tubular; providing the downhole tubular connector with a seal protector adapted to selectively protect the seal; arranging, e.g. movably disposing, the seal protector and seal with respect to one another such that in a first position at least a portion of the seal is covered by the seal protector, and in a second position the portion of the seal is exposed; and exposing the seal by moving the seal protector from the first position to the second position.

The method may further comprise moving the seal protector from the first position to the second position by virtue of an interaction (e.g., contact) of the seal protector with the downhole tubular. The interaction may occur as the downhole tubular connector is brought into engagement with the downhole tubular.

The method may further comprise biasing the seal protector into the first position.

The method may further comprise providing the downhole tubular connector with a second body portion. The seal protector may be connected to the second body portion. The method may further comprise extending the first body portion with respect to the second body portion so as to expose the portion of the seal.

The seal protector may comprise a threaded portion. The method may further comprise engaging the threaded portion with a corresponding thread on the downhole tubular. The threaded portion may be provided on an inner or an outer surface of the seal protector and accordingly may engage an outer or an inner thread on the downhole tubular respectively.

The method may further comprise providing the downhole tubular connector with a second body portion in fluid communication with a flow source. The first body portion may be selectively extendable with respect to the second body portion. Fluid may be permitted to selectively flow from the fluid source through the second and first body portions and into the downhole tubular. The method may further comprise selectively connecting a top drive assembly to the downhole tubular. The flow source may comprise a top drive assembly, e.g., a bore of a quill of the top drive assembly.

Other aspects and advantages of the invention will be apparent from the following description and the appended claims.

BRIEF DESCRIPTION OF DRAWINGS

For a better understanding of the present disclosure, and to show more clearly how it may be carried into effect, reference will now be made, by way of example, to the accompanying drawings, in which.

DETAILED DESCRIPTION

Figure 2A:
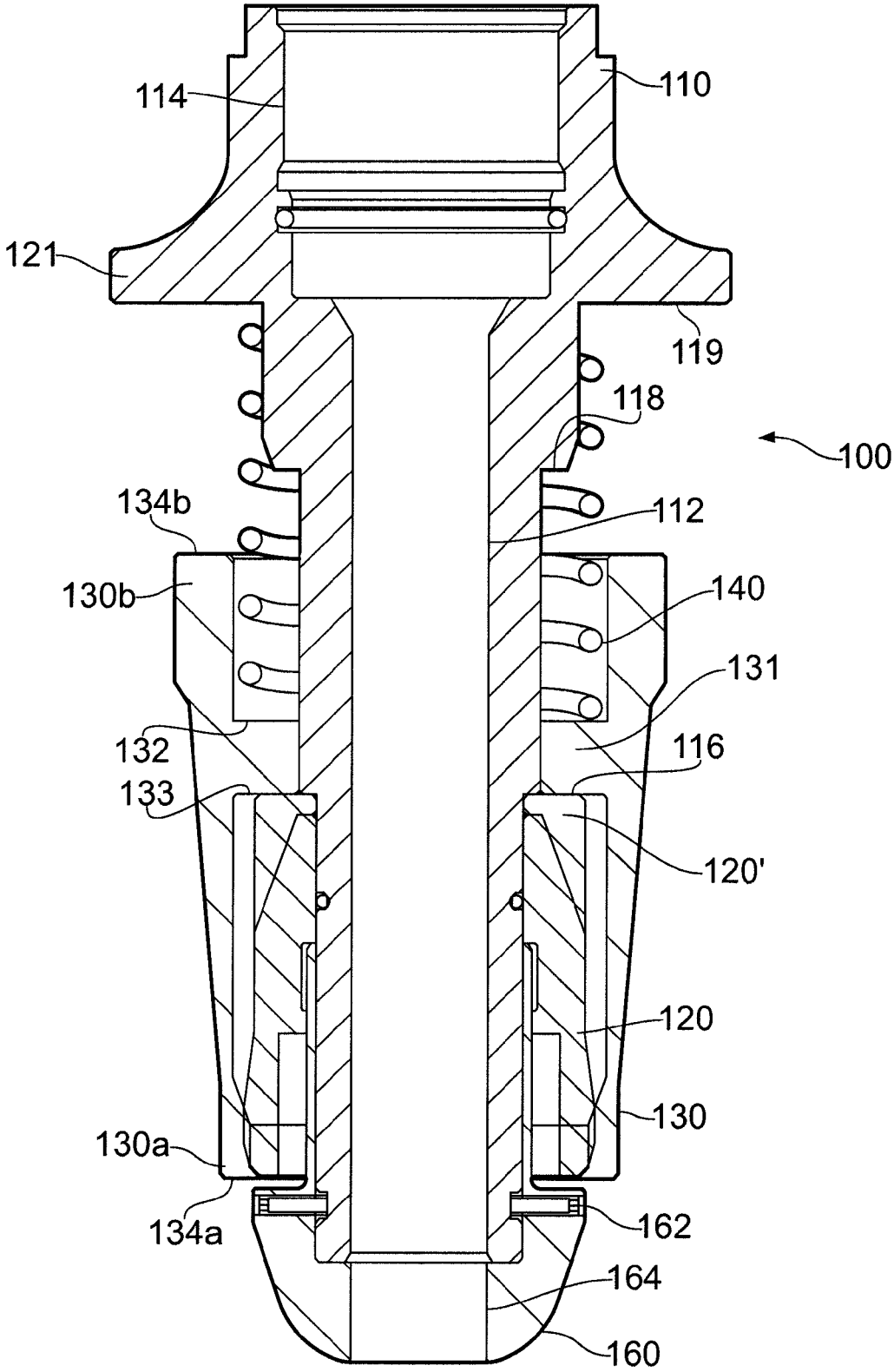
FIGS. 2*a* and 2*b* show a downhole tubular connector according to a first embodiment of the present disclosure with a seal protector in an extended position (FIG. 2*a*) and the seal protector in a retracted position (FIG. 2*b*)
Figure 2B:
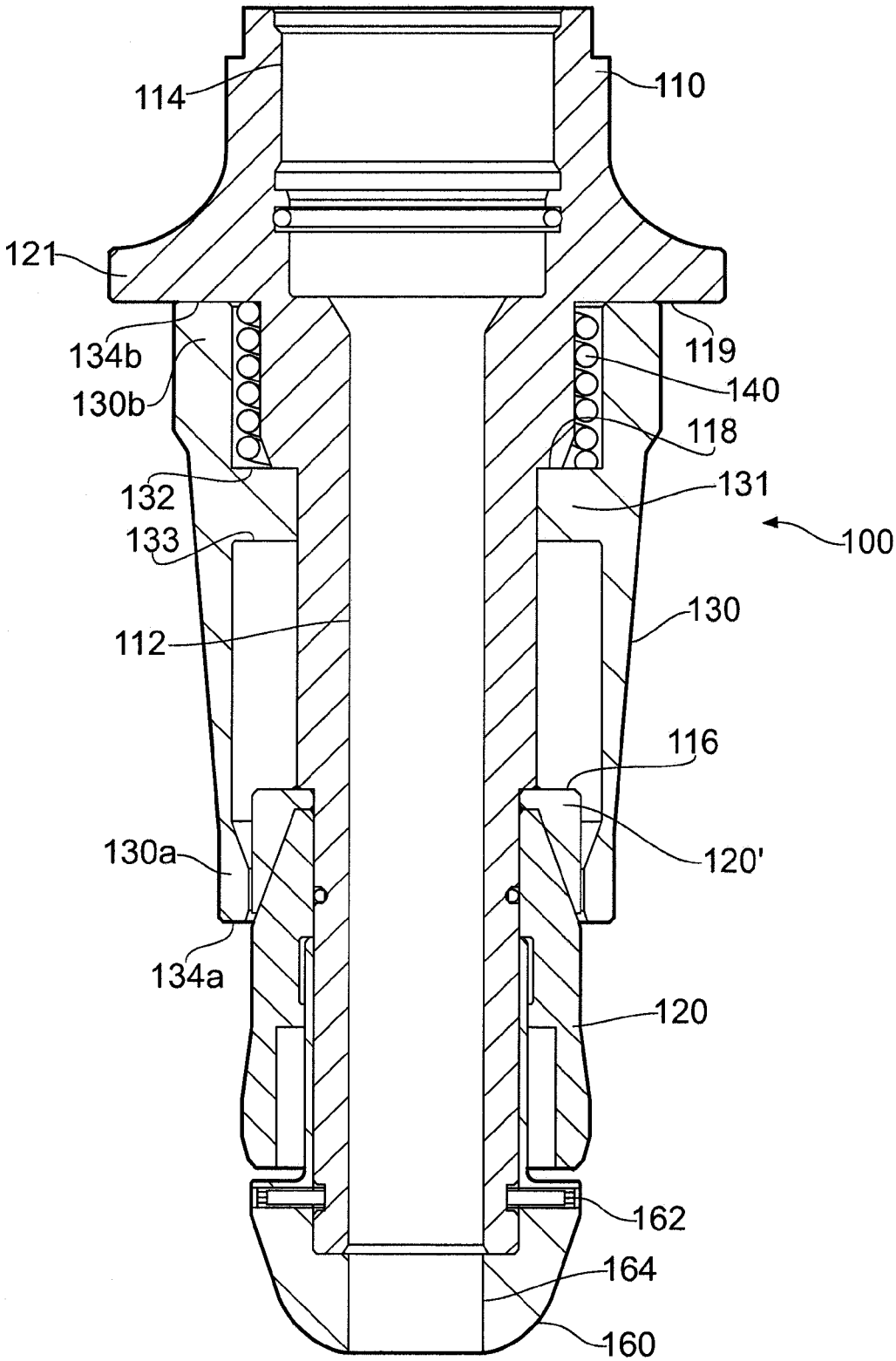

With reference to FIGS. 2*a* and 2*b*, a downhole tubular connector 100 according to a first embodiment of the present disclosure may comprise a body 110 (e.g., with a bore therethrough) and a seal 120 connected to the body 110 (e.g., connected to an external surface of the body 110). The seal

Figure 1A:
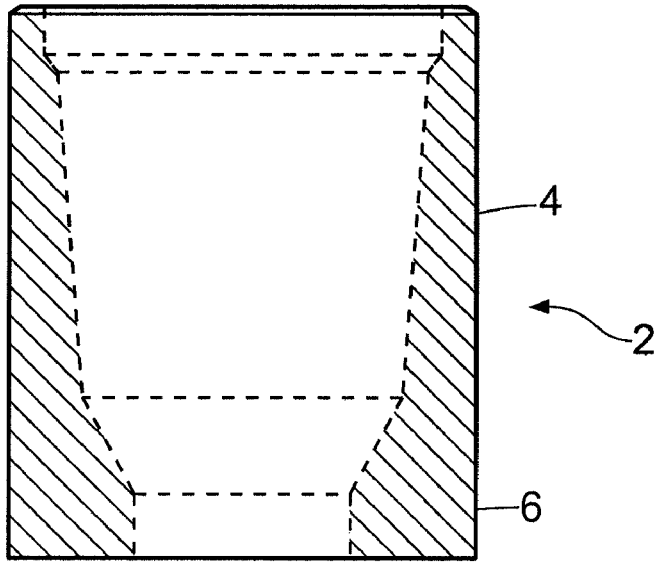
FIG. 1*a* shows a box connection for a downhole tubular with a tapered connection.
Figure 1B:
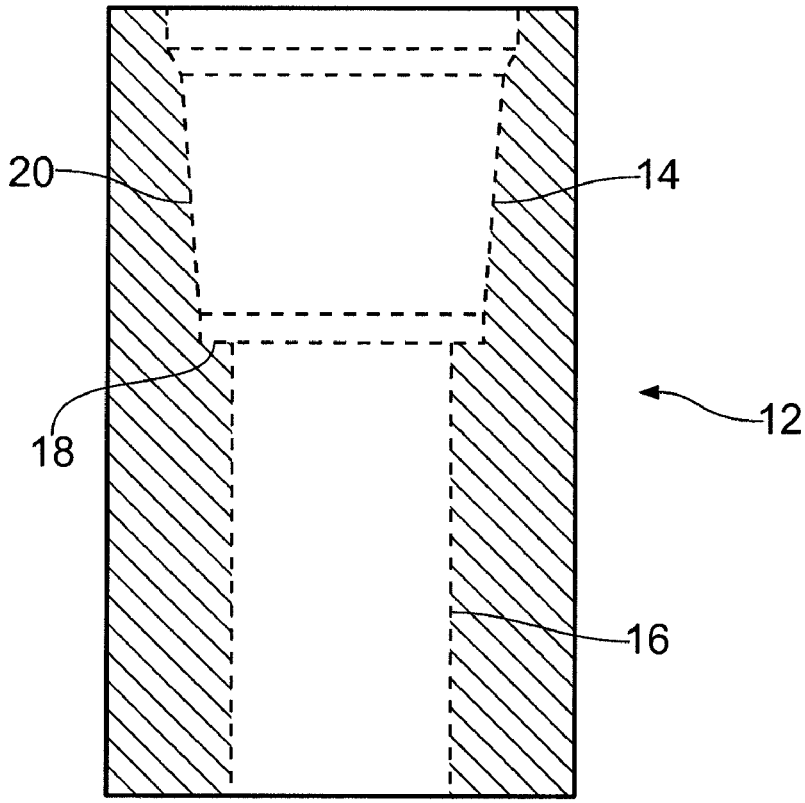
FIG. 1*b* shows a box connection for a downhole tubular with a double shouldered connection.

120 may be selected and/or adapted to selectively provide a seal with a downhole tubular, for example, to seal against the bore 6 of the downhole tubular 2 shown in FIG. 1*a* or the bore 16 of the downhole tubular 12 shown in FIG. 1*b*. The downhole tubular may comprise a drill string or a casing string or any other tubular. The seal 120 may comprise a resilient material, for example rubber, and the seal may comprise a cup seal.

The depicted downhole tubular connector 100 further comprises a seal protector for protecting the seal 120. The seal protector may be in the form of a sleeve 130. The sleeve 130 may be slidably disposed relative to the body 110 and/or seal 120 such that the sleeve 130 may be movable from a first position (as shown in FIG. 2*a*) to a second position (as shown in FIG. 2*b*). In the first position, at least a portion of the seal 120 may be covered (e.g., protected from contact with downhole tubular) by a first end 130*a* of the sleeve 130. In the second position, the portion of the seal 120, which had been covered in the first position, may be exposed. For example, the seal 120 may be protected from damage when the sleeve 130 is in the first position and the seal may be exposed so that it may seal against the downhole tubular when in the second position.

The sleeve 130 may be disposed so as to be movable from the first (e.g., protected) position to the second (e.g., exposed) position by virtue of an interaction of the sleeve 130 with the downhole tubular, for example, as the downhole tubular connector 100 is brought into engagement with the downhole tubular. More specifically, the sleeve 130 may be configured to engage an internal abutment shoulder 18 provided within the downhole tubular 12, e.g., as shown in FIG. 1*b* (see FIG. 3(*c*) for example). A first end face 134*a* of the sleeve 130 may interact with the internal abutment shoulder 18 by abutting it when the downhole tubular connector 100 is brought into engagement with the downhole tubular such that the sleeve 130 is moved from the first position to the second position, e.g., as the downhole tubular connector 100 continues to be inserted into the downhole tubular. Alternatively, the seal protector (e.g. sleeve 130) may be configured to engage a shoulder at the topmost end of the downhole tubular, for example an external end face of a box connection or a pin connection (for example in the case of a string of downhole tubulars with upwardly facing pin connections).

The depicted seal 120 seals against the inner diameter of the bore 6, 16 of the downhole tubular 2, 12 beyond the box connection. The sleeve 130 protects (e.g., restricts contact with) the seal 120 from the shoulder 18 and/or threads of the box connection 4, 14 as the seal is brought into engagement with the bore 6, 16 of the downhole tubular 2, 12 beyond the box connection. The sleeve 130 may be slidably disposed with respect to the body 110. The sleeve may engage the box connection 4, 14 of the downhole tubular 2, 12 with or without rotation.

At least a portion of the seal 120 may be resiliently biased against an inner diameter of the first end 130*a* of the sleeve 130 and/or the inner diameter of the bore 6, 16 of the downhole tubular 2, 12 beyond the box connection. The portion of the seal 120 may be resiliently biased against the inner diameter of the bore 6, 16 of the downhole tubular 2, 12 beyond the box connection in order to ensure a seal is made between the body 110 and the bore 6, 16 of the downhole tubular 2, 12. Furthermore, an inner diameter of the first end 130*a* of the sleeve 130 may be substantially equivalent to the inner diameter of the bore 6, 16 of the downhole tubular 2, 12 beyond the box connection, such that there is substantially no step change in the inner diameter as the seal 120 moves from the sleeve 130 to the bore 6, 16 of the downhole tubular 2, 12. Accordingly, the seal 120 may be resiliently biased against an inner diameter of the first end 130*a* of the sleeve 130 as a result of the inner diameter of the first end 130*a* of the sleeve 130 being substantially equivalent to the inner diameter of the bore 6, 16 of the downhole tubular 2, 12 beyond the box connection. A smooth transition (e.g. limiting damage to the seal) for the seal 120 from the seal protector (e.g. sleeve 130) to the bore 6, 16 of the downhole tubular 2, 12 beyond the box connection may occur. The smooth transition may be made possible by the inner diameter of the first end 130*a* of the sleeve 130 being substantially equivalent to the inner diameter of the bore 6, 16 of the downhole tubular 2, 12 beyond the box connection.

The downhole tubular connector 100 may further comprise a resilient element 140 disposed so as to bias the sleeve 130 to the first position (and/or the second position). The resilient element may for example comprise a spring, a bellows or a fluidic (e.g., pneumatic or hydraulic) chamber. Alternatively, the downhole tubular connector may not comprise a resilient element and may rely on gravity to bias the sleeve 130 into the first position. The sleeve 130 may comprise a first shoulder 132 and the resilient element 140 may engage the first shoulder 132. The first shoulder 132 may be internal with respect to the remainder of the sleeve 130 and the resilient element 140 may be at least partially guided within a second end 130*b* of the sleeve 130. The second end 130*b* of the sleeve 130 may at least partially surround the resilient element 140 (e.g., spring) to resist lateral movement of the resilient element 140. The internal diameter of sleeve 130 at its second end 130*b* may correspond in size to the outer diameter of the resilient element 140 such that the sleeve 130 may limit lateral movement of the resilient element 140. For example, the internal diameter of sleeve 130 at its second end 130*b* may be greater than the outer diameter of the resilient element 140, although the difference in the two diameters may be sufficiently small to limit lateral movement of the resilient element 140. Furthermore, the internal first shoulder 132 may be provided on an inwardly facing protrusion 131 disposed on the sleeve 130. The protrusion 131 may be disposed so as to slidably engage with the body 110.

Downhole tubular connector 100 may comprise a first abutment surface 116 disposed so as to restrict movement of the sleeve 130 beyond the first position. For example, in the embodiment shown, the first abutment surface 116 may be formed by an end of a portion of the seal 120, e.g. a seal retainer 120'. In particular, the first abutment surface 116 may be formed by the end of the portion of the seal 120, e.g. seal retainer 120', being greater in diameter than the portion of the body 110 about which the sleeve 130 may slide. For example, the seal retainer 120' may fit against the body 110 and the outer diameter of the seal retainer 120' may be greater than the outer diameter of the body 110 where the seal retainer 120' meets the body 110. As a result, the first abutment surface 116 may be formed by a surface defined by the end of the seal retainer 120'. The seal retainer 120' may in turn abut a shoulder provided on the body 110, so that the seal 120 may be prevented from sliding with respect to the body 110. The first abutment surface 116 may be disposed in order to abut a second abutment shoulder 133 provided on the sleeve 130. The second abutment surface may also be provided on the protrusion 131 provided on the sleeve 130. The downhole tubular connector 100 may comprise a second abutment surface 118 disposed so as to restrict movement of the sleeve 130 beyond the second position. The second abutment surface 118 may abut the first shoulder 132 of the sleeve 130. The downhole tubular connector 100 may additionally comprise a further abutment surface 119, which may be formed by a flange portion 121. The further abutment surface 119 may be disposed so as to limit movement of the sleeve 130 beyond the second position. The further abutment surface 119 may abut a second end face 134*b* of the sleeve 130.

The downhole tubular connector 100 may comprise a centralising member 160 (e.g., nose cone) provided on a distal end of the body 110. The centralising member may be disposed so as to centralise the downhole tubular connector 100 with respect to the bore 6, 16 of the downhole tubular 2, 12 beyond the box connection as the downhole tubular connector 100 is brought into engagement with the downhole tubular. For example, the centralising member 160 may assist in ensuring that the downhole tubular connector 100 is substantially laterally aligned with the bore 6, 16 of the downhole tubular 2, 12, e.g., for entry therein. The centralising action of the centralising member 160 may be by virtue of its shape and dimensions. For example, the centralising member 160 may be frustoconical in shape. Accordingly, a distal end of the centralising member 160 may have an outer diameter which is less than the inner diameter of the bore 6, 16 of the downhole tubular 2, 12 beyond the box connection. The opposite end of the centralising member 160, e.g., that nearest the seal 120, may have an outer diameter which is less than the inner diameter of the bore 6, 16 of the downhole tubular 2, 12 beyond the box connection. However, the outer diameter of the opposite end of the centralising member 160 may be sufficiently close in size to the inner diameter of the bore 6, 16 of the downhole tubular 2, 12 beyond the box connection, such that the centralising member 160 may perform its centralising function, e.g., that it limits lateral movement of the downhole tubular connector. Furthermore, the opposite end of the centralising member 160 may have an outer diameter which is also less than the outermost diameter of the seal 120 such the seal may contact the inner diameter of the bore 6, 16 of the downhole tubular 2, 12 beyond the box connection. The centralising member 160 may be secured to the body 110 of the downhole tubular connector 100 by virtue of a grub screw (i.e., set screw) 162, which is threaded through a side wall of the centralising member 160 into engagement with the body 110.

In addition, the sleeve 130 may be configured to selectively engage a portion of the downhole tubular and to centralise the seal 120 of the downhole tubular connector with respect to the downhole tubular. The outer diameter of the sleeve 130 may be substantially equivalent to the internal diameter of the threaded portion of the box connection 4, 14 such that the sleeve 130 may fit against the threaded portion of the box connection. For example, with the first embodiment shown in FIGS. 2 and 3, the sleeve may contact the threaded portion of the box connection 4, 14 and/or a shoulder 18 adjacent to the threaded portion of the downhole tubular 2, 12. Sleeve 130 may resist lateral movement of the downhole tubular connector with respect to the downhole tubular. This resistance may ensure that the seal 120 is aligned with the bore 6, 16 of the downhole tubular so that when the seal 120 is exposed the seal does not contact (e.g., is not damaged) on the internal shoulder 18. Furthermore, the sleeve 130 may assist in ensuring that the longitudinal axis of the downhole tubular connector 100 is substantially aligned with the longitudinal axis of the downhole tubular 2, 12.

The body 110 of the downhole tubular connector 100 may comprise a passage in the form of a bore 112. The centralising member 160 may comprise a corresponding bore 164. The bores 112, 164 may be adapted to transfer fluids to and/or from the downhole tubular, for example once the seal 120 has sealed against the downhole tubular.

The downhole tubular connector 100 may be connected (e.g., threadably connected) to the extendable portion of the connector disclosed in GB2435059. The extendable portion may connect with a (e.g., female threaded) socket 114 provided in the body 110 of the downhole tubular connector 100. The connector disclosed in GB2435059 may in turn connect to a drilling rig fluid supply, e.g., by connecting to the quill of a top drive assembly. The downhole tubular connector 100 of the present disclosure may therefore selectively connect a top drive assembly to the downhole tubular to transmit fluids therebetween.

Figure 3:
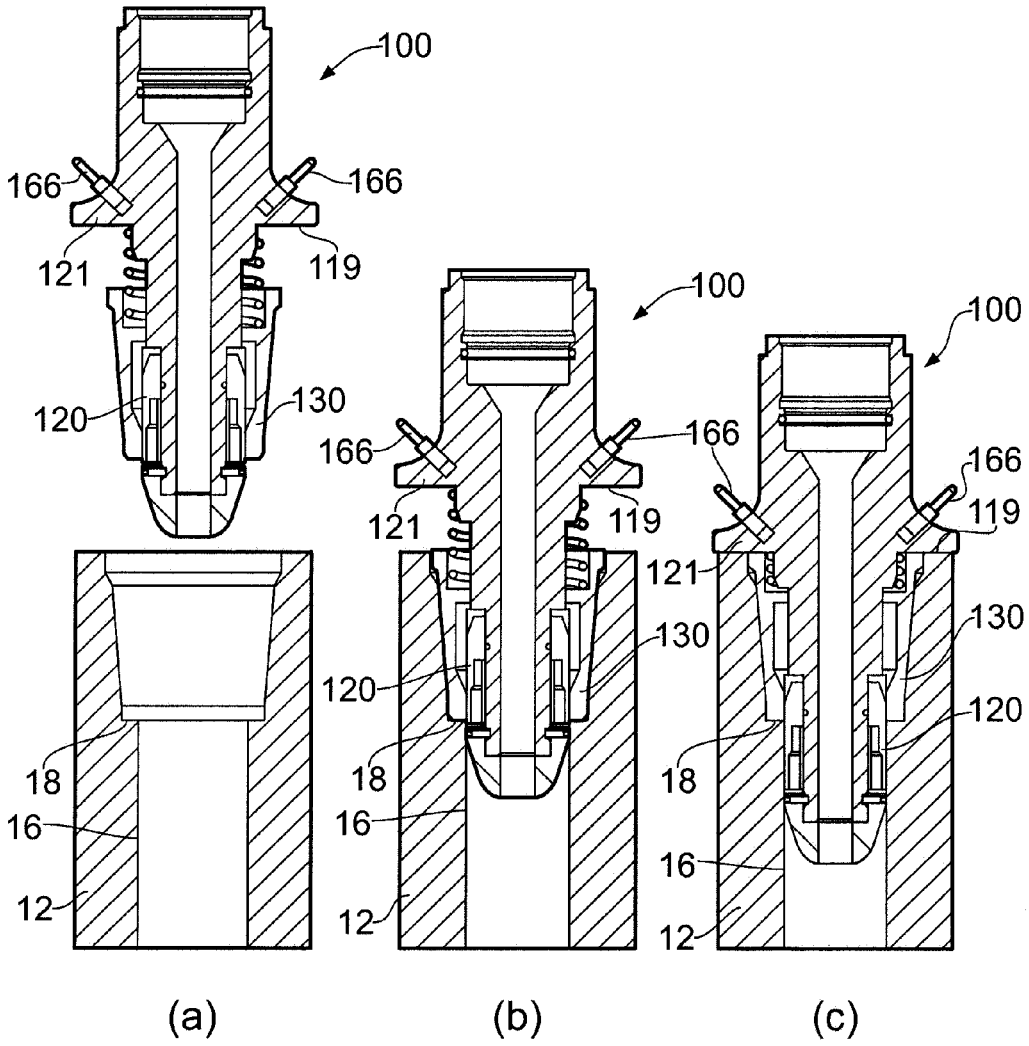
FIGS. 3*a*, 3*b* and 3*c* show the downhole tubular connector, according to the first embodiment of the present disclosure, positioned relative to a double shouldered downhole tubular before engagement (FIG. 3*a*), during engagement (FIG. 3*b*) and after engagement with the connector sealed against the downhole tubular (FIG. 3*c*)

With reference to FIG. 3, the various stages of the lowering process are shown. FIG. 3*a* shows the downhole tubular connector 100 prior to insertion into the downhole tubular 12. FIG. 3*b* shows a downhole tubular connector 100 at a point during the lowering of the downhole tubular connector 100 into the downhole tubular 12 when the sleeve 130 has first contacted the internal abutment shoulder 18 and the sleeve 130 is still in the first (e.g., protected) position. By contrast, FIG. 3*c* shows the downhole tubular connector 100 in the fully lowered position with the sleeve 130 in the second (e.g., exposed) position exposing the seal 120 and with the seal 120 sealed against an internal wall of the bore 16 of the downhole tubular 12. As the downhole tubular connector 100 has been lowered, the seal 120 has been protected from contact with the internal abutment shoulder 18 by the retractable sleeve 130. In the lowered position, the further abutment shoulder 119 formed by the flange portion 121, may also abut the downhole tubular 12.

FIG. 3 also shows that the downhole tubular connector 100 may additionally comprise one or more hooks 166. The hooks 166 may be in the form of eyelets which may be attached to, or be unitary with, the body 110 of the downhole tubular connector 100. The hooks 166 may be provided on the flange portion 121. The downhole tubular connector 100 may be raised and/or lowered by a connection with the hooks 166. For example, a pair of elevator links (bails) may connect to the hooks 166 to connect a top drive assembly (e.g., the link (bail) ears thereof) to the downhole tubular connector 100. The downhole tubular connector 100 may also be raised and/or lowered by a connection to the socket 114, e.g., the quill of a top drive threadably connected (directly or indirectly) to the socket 114.

Figure 4:
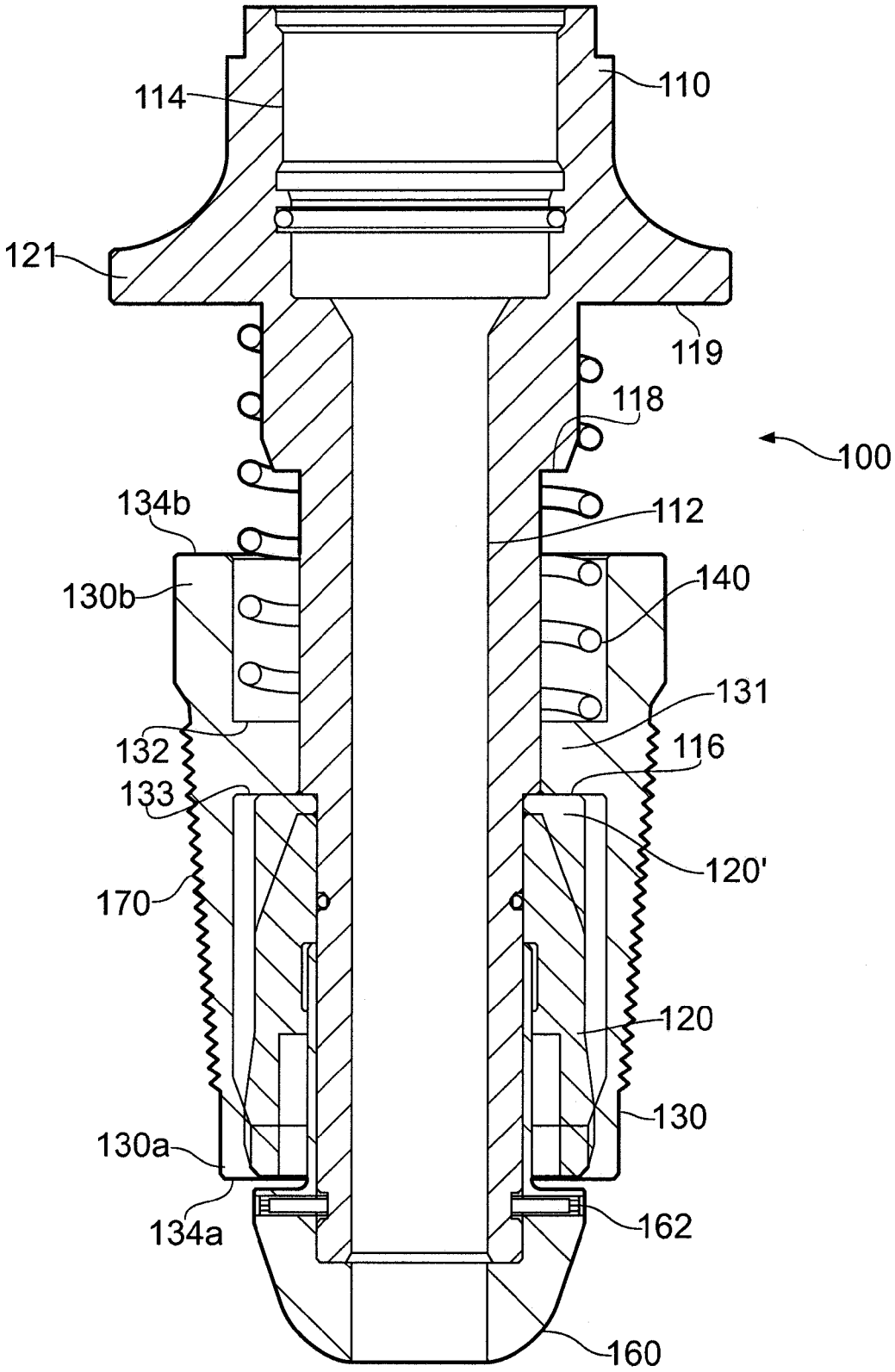
FIG. 4 shows a downhole tubular connector according to an alternative arrangement of the first embodiment of the present disclosure.

Referring to FIG. 4, the seal protector according to an alternative arrangement of the first embodiment may comprise a threaded portion 170. The threaded portion 170 may be adapted to engage a corresponding thread in the box connection 4, 14 of the downhole tubular. The threaded portion 170 may be provided on an outer surface of the seal protector (i.e. sleeve 130) and accordingly may engage an inner thread on the downhole tubular. When the downhole tubular connector is lowered to engage the downhole tubular, the sleeve 130 may be rotated in order to engage the threads of the downhole tubular. The seal protector may be rotated either by rotating the seal protector separately or by rotating the downhole tubular connector. Splines (not shown) may be provided between the sleeve 130 and the body 110 to ensure that the sleeve and body are rotatably linked but that the sleeve is free to slide axially with respect to the body. In a similar manner to that shown in FIG. 3, when the downhole tubular connector is lowered further, the sleeve moves and reveals the seal, which is then able to engage the bore of the downhole tubular. (FIG. 4 shows the sleeve 130 in the first position protecting the seal 120.)

Figure 5:
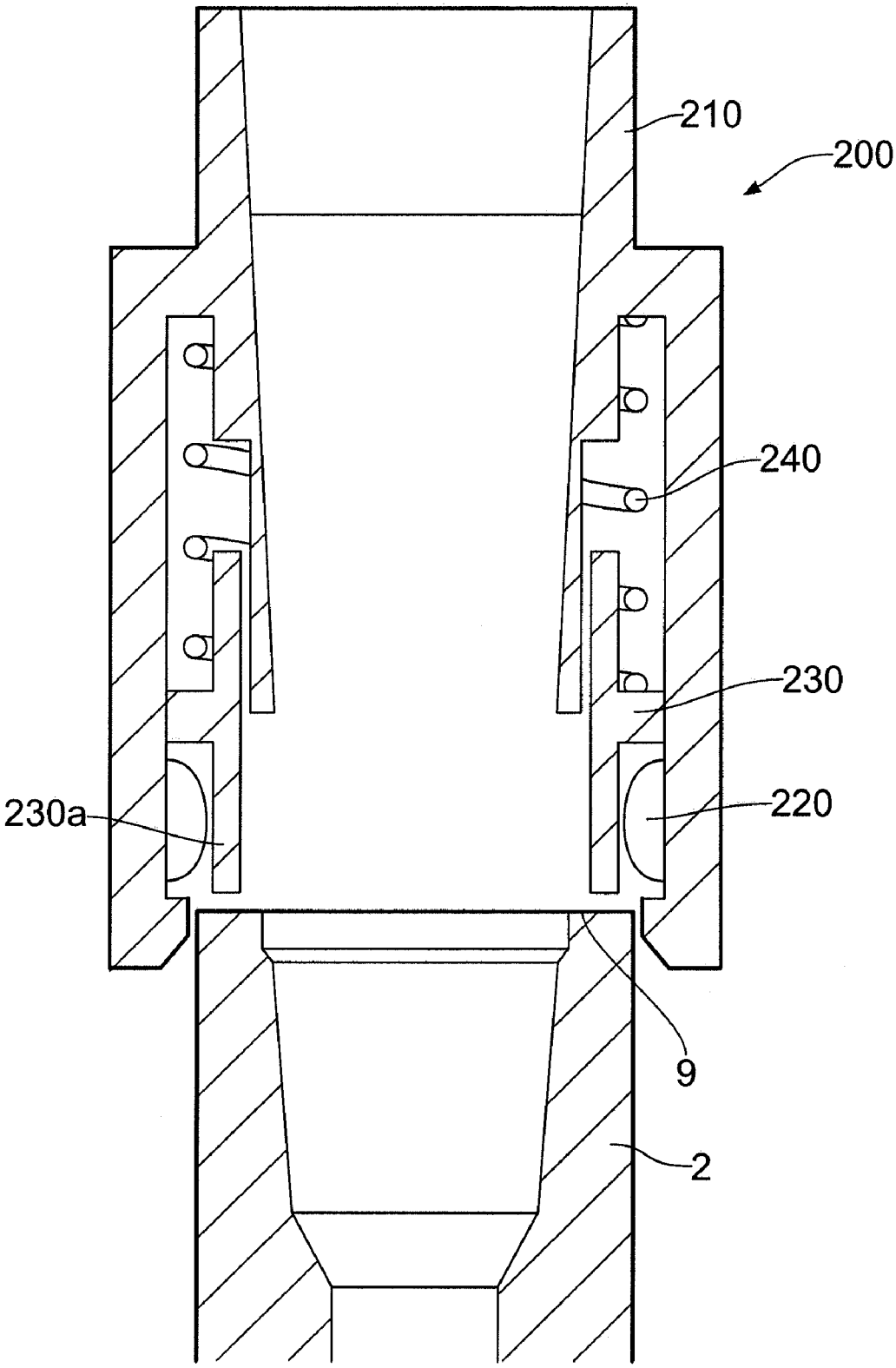
FIG. 5 is a schematic of a downhole tubular connector according to a second embodiment of the present disclosure.

Referring to FIG. 5, a seal 220, according to a second embodiment of the present disclosure, may be provided internally with respect to a body 210 of a downhole tubular connector 200. In other words, the downhole tubular connector 200 may seal against an external surface of the downhole tubular 2. The downhole tubular connector 200 may comprise a seal protector 230 slidably disposed internally with respect to the seal 220 and body 210. The seal protector 230 may be movable from a first position to a second position. In the first position, at least a portion of the seal 220 may be covered (e.g., protected from contact with downhole tubular) by a first end 230*a* of the seal protector 230. In the second position, the portion of the seal 220, which had been covered in the first position, may be exposed. For example, the seal 230 may be protected from damage when the sleeve 230 is in the first position and the seal may be exposed so that it may seal against the downhole tubular when in the second position. The seal protector 230 may be disposed so as to selectively expose the seal upon contact of the first end 230*a* of the seal protector with a shoulder 9 of the downhole tubular 2. (FIG. 5 shows an embodiment of a downhole tubular connector 200 prior to engagement with the downhole tubular 2 and as such shows a seal protector 230 protecting the seal 220 in the first position.) The seal protector 230 may be biased by a resilient element 240 into the first position.

Figure 6A:
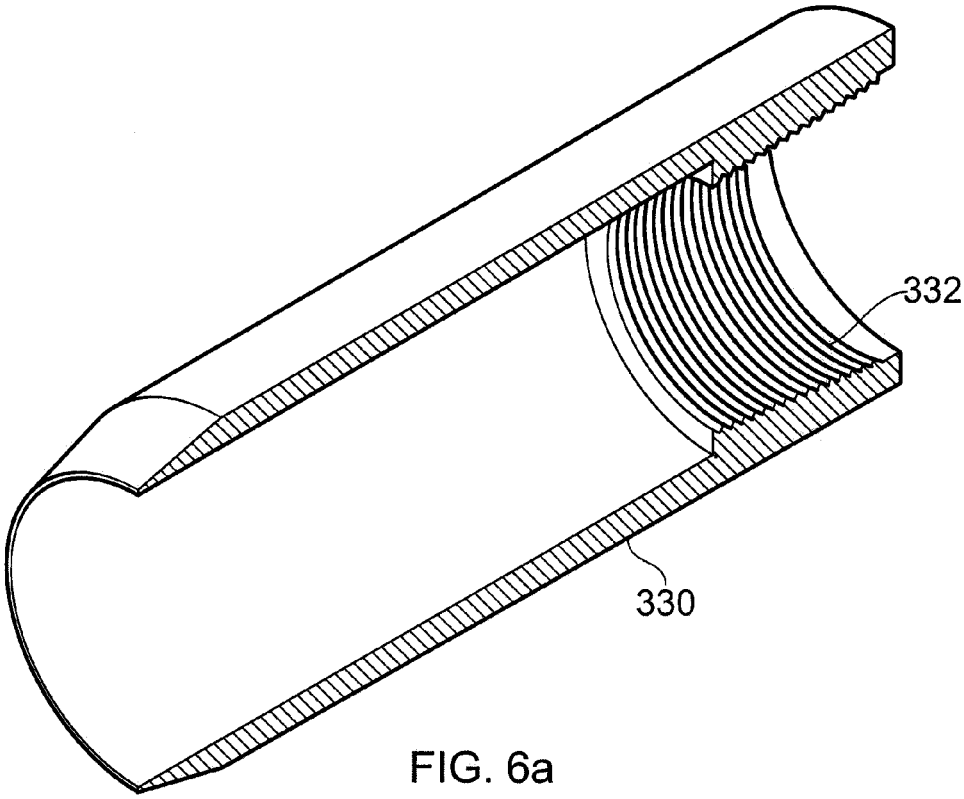
FIGS. 6*a* and 6*b* show a downhole tubular connector according to a third embodiment of the present disclosure with FIG. 6*a* showing a seal protector and FIG. 6*b* showing the seal protector connected to a body portion of the downhole tubular connector.
Figure 6B:
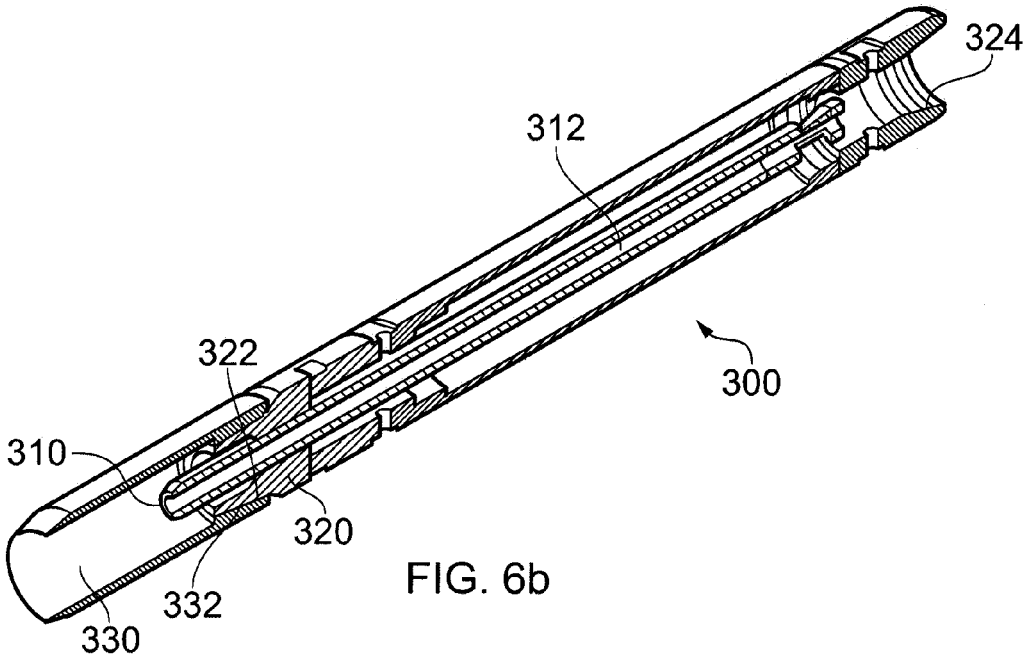
Figure 7:
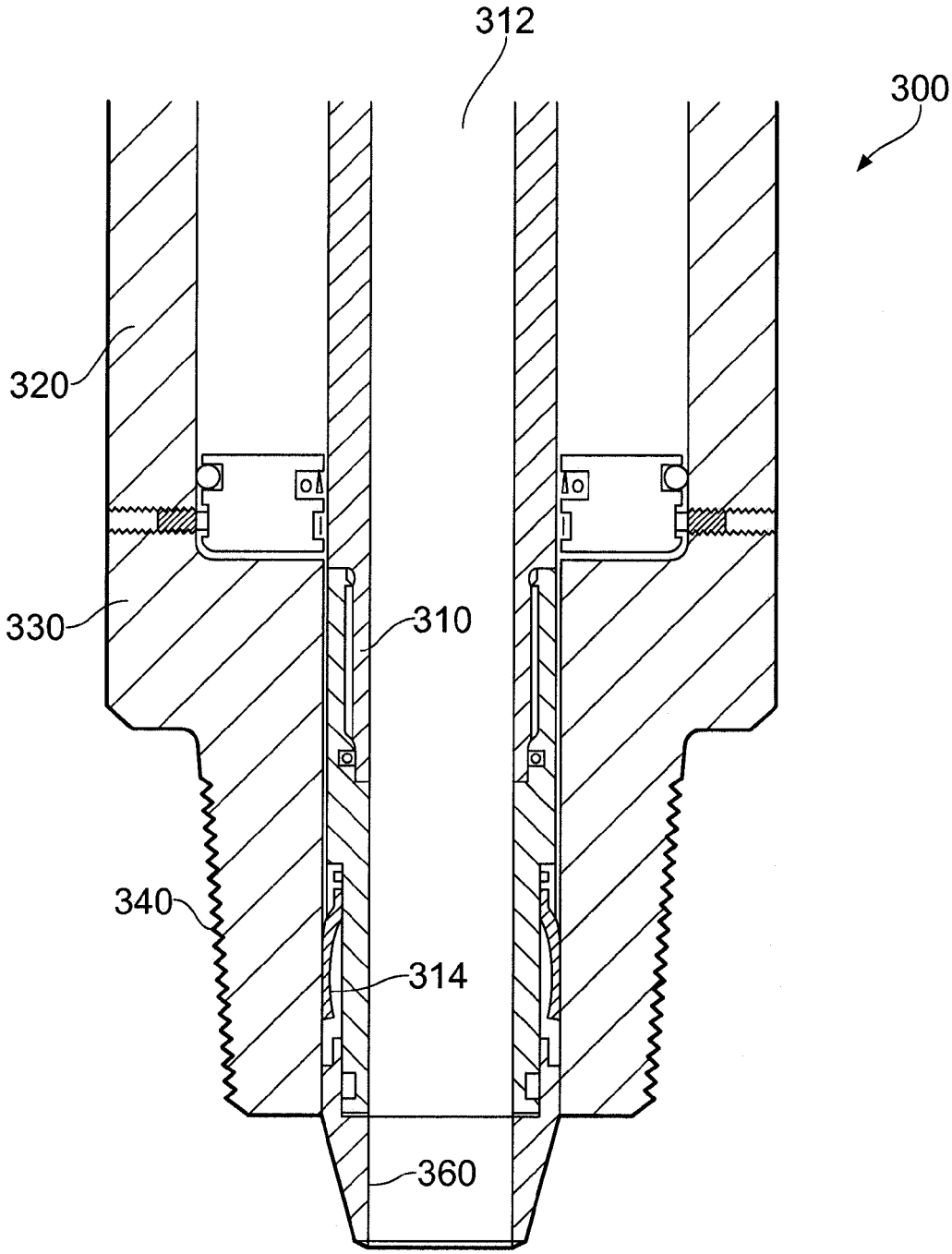
FIG. 7 is a partial sectional view showing the downhole tubular connector according to a fourth embodiment of the present disclosure.

With reference to FIGS. 6*a*, 6*b* and 7, a downhole tubular connector 300 according to third and fourth embodiments of the present disclosure may comprise a first body portion 310 and a seal 314 provided on the first body portion 310. The seal 314 may be provided at a distal end of the first body portion 310 and the seal may be substantially similar to the seal 120 shown in FIGS. 2 and 3. The seal 314 may be detachably connected to the first body portion 310. Furthermore, the downhole tubular connector may further comprise a second body portion 320. The first body portion 310 may be selectively extendable with respect to the second body portion 320 and as a result, the seal may be selectively brought into sealing engagement with the downhole tubular. (The same arrangement may apply equally to the first embodiment shown in FIGS. 2 and 3, for example, the body 110 may be extendable from a further body.)

The seal 314 may be adapted to selectively provide a seal with a downhole tubular, for example, the bore 6 of the downhole tubular 2 shown in FIG. 1*a* or, as shown in FIG. 3(*c*), the bore 16 of the downhole tubular 12 shown in FIG. 1*b*. The downhole tubular may comprise a drill string or a casing string or any other tubular. The seal 314 may comprise a resilient material, for example rubber, and the seal may comprise a cup seal.

The downhole tubular connector 300 may further comprise a seal protector 330. The seal may be movable with respect to the seal protector 330, for example, by virtue of the first body portion 310 extending with respect to the second body portion 320. In other words, the seal may be movable from a first position, in which at least a portion of the seal is protected by a first end of the seal protector 330, to a second position, in which the seal is exposed so it may contact and thus seal against a downhole tubular. The depicted seal 314 selectively seals against the inner diameter of the bore 6, 16 of the downhole tubular 2, 12 beyond the box connection. The depicted seal protector 330 protects the seal 314 from the shoulder 18 and/or threads of the box connection 4, 14 as the seal is brought into engagement with the bore 6, 16 of the downhole tubular 2, 12 beyond the box connection.

As shown in FIG. 6, the seal protector 330 according to the third embodiment of the present disclosure may be in the form of a sleeve and the seal protector 330 may be connected to the second body portion 320. In particular, the seal protector 330 may be detachably connected to the second body portion 320. The seal protector 330 may comprise a first threaded portion 332, which may be provided on an internal surface of the seal protector 330. The first threaded portion 332 may engage a corresponding threaded portion 322 provided on the second body portion 320. In an alternative arrangement (not shown), the seal protector 330 may be releasably clamped to the second body portion 320.

The seal protector 330 may be arranged so as to centralise the downhole tubular connector 300 with respect to the downhole tubular when the downhole tubular connector 300 is brought into engagement with the downhole tubular. The seal protector 330 may therefore ensure that the seal is correctly orientated with respect to the bore of the downhole tubular, thereby ensuring that the seal is not damaged when it is extended into the bore of the downhole tubular. For example, the seal protector 330 may assist in ensuring that the longitudinal axis of the downhole tubular connector 300 is substantially aligned with the longitudinal axis of the downhole tubular 2, 12.

The downhole tubular connector 300 may comprise a centralising member 360 provided on a distal end of the first body portion 310 or seal 314. The centralising member 360 may be disposed to centralise the downhole tubular connector with respect to a bore of the downhole tubular as the downhole tubular connector is brought into engagement with the downhole tubular. For example, the centralising member 360 may urge the downhole tubular connector 300 into substantial lateral alignment with the bore 6, 16 of the downhole tubular 2, 12.

The first body portion 310 of the downhole tubular connector 300 may comprise a passage in the form of a bore 312. The bore 312 may be adapted to transfer fluids to or from the downhole tubular, for example once the seal has sealed against the downhole tubular.

The downhole tubular connector 300 may connect to a top drive assembly via a (e.g., female threaded) socket 324 provided in a distal end of the second body portion 320. The downhole tubular connector 300 of the present disclosure may therefore selectively connect a top drive assembly to the downhole tubular to transmit fluids therebetween.

Figure 8:
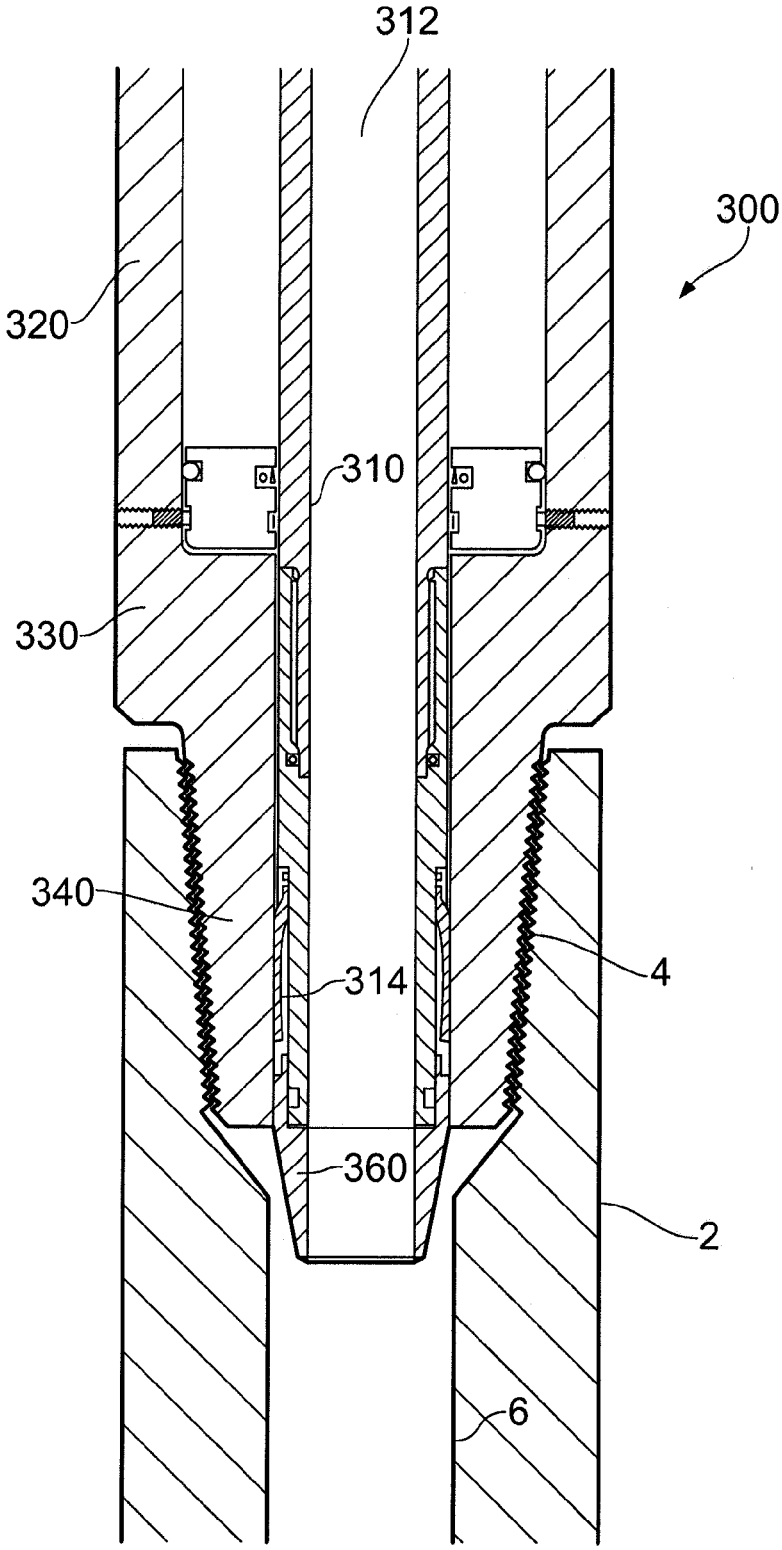
FIG. 8 is a partial sectional view showing the downhole tubular connector according to the fourth embodiment of the present disclosure engaged with a downhole tubular.

As shown in FIG. 7, the seal protector 330 of the downhole tubular connector 300 according to the fourth embodiment of the present disclosure may comprise a threaded portion 340 (e.g., pin end). The threaded portion may be adapted to engage a corresponding thread on the downhole tubular. The threaded portion may be provided on an inner or an outer surface of the seal protector 330 and accordingly may engage an outer or an inner thread on the downhole tubular respectively. For example, as shown in FIG. 8, the threaded portion 340 may engage the threads of the box connections 4, 14 and the seal protector 330 may be shaped and sized appropriately for engagement with said box connections. The seal protector 330 may at least partially have the form of a conventional pin of a box and pin connection.

When the downhole tubular connector 300 is lowered to engage the downhole tubular, the seal protector 330 may be rotated in order to engage the threads of the downhole tubular with the threaded portion 340. The seal 314 may then be brought into engagement with the bore of the downhole tubular by virtue of extending the first body portion 310 with respect to the second body portion 320.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the invention should be limited only by the attached claims.

What is claimed is:

1. A downhole tubular connector comprising a first body portion and a seal provided on the first body portion, the seal being adapted to selectively provide a seal with a downhole tubular, the downhole tubular connector further comprises a seal protector, wherein one of the seal protector and seal is movable with respect to the other of the seal protector and seal, the seal protector or seal being movable from a first position, in which at least a portion of the seal is protected by a first end of the seal protector, to a second position, in which the portion of the seal is exposed;

wherein the seal protector is movable from the first position to the second position by contact of the seal protector with the downhole tubular, wherein the downhole tubular connector further comprises a resilient element disposed so as to bias the seal protector to the first position, wherein the seal protector comprises a shoulder and the resilient element engages the shoulder, and wherein a second end of the seal protector at least partially surrounds the resilient element to resist lateral movement of the resilient element.

2. The downhole tubular connector of claim 1, wherein the resilient element comprises a spring.

3. The downhole tubular connector of claim 1, wherein the downhole tubular connector comprises a first abutment surface disposed so as to limit movement of the seal protector beyond the first position.

4. The downhole tubular connector of claim 1, wherein the downhole tubular connector comprises a second abutment surface disposed so as to limit movement of the seal protector beyond the second position.

5. The downhole tubular connector of claim 1, wherein the seal protector is configured to engage an abutment shoulder within the downhole tubular.

6. The downhole tubular connector of claim 1, wherein the seal protector is configured to selectively engage a portion of the downhole tubular and to substantially centralise the longitudinal axis of the downhole tubular connector with respect to a bore of the downhole tubular.

7. The downhole tubular connector of claim 1, wherein the seal is adapted to selectively fit inside and seal against an internal bore of the downhole tubular.

8. The downhole tubular connector of claim 7, wherein the seal is adapted to selectively fit inside and seal against a portion of the bore of the downhole tubular below a box connection.

9. The downhole tubular connector of claim 1, wherein the first body portion comprises a bore adapted to transfer fluids to or from the downhole tubular.

10. A downhole tubular connector comprising a first body portion and a seal provided on the first body portion, the seal being adapted to selectively provide a seal with a downhole tubular, the downhole tubular connector further comprises a seal protector, wherein one of the seal protector and seal is movable with resect to the other of the seal protector and seal, the seal protector or seal being movable from a first position, in which at least a portion of the seal is protected by a first end of the seal protector, to a second position, in which the portion of the seal is exposed;

wherein the seal protector is movable from the first position to the second position by contact of the seal protector with the downhole tubular, wherein the downhole tubular connector further comprises a resilient element disposed so as to bias the seal protector to the first position, wherein the seal protector comprises a shoulder and the resilient element engages the shoulder, wherein the shoulder is disposed so as to slidably engage with the first body portion.

11. A downhole tubular connector comprising a first body portion and a seal provided on the first body portion, the seal being adapted to selectively provide a seal with a downhole tubular, the downhole tubular connector further comprises a seal protector, wherein one of the seal protector and seal is movable with respect to the other of the seal protector and seal, the seal protector or seal being movable from a first position, in which at least a portion of the seal is protected by a first end of the seal protector, to a second position, in which the portion of the seal is exposed;

wherein the downhole tubular connector further comprises a second body portion, the first body portion being extendable with respect to the second body portion and wherein the seal protector is connected to the second body portion.

12. A downhole tubular connector comprising a first body portion and a seal provided on the first body portion, the seal being adapted to selectively provide a seal with a downhole tubular, the downhole tubular connector further comprises a seal protector, wherein one of the seal protector and seal is movable with respect to the other of the seal protector and seal, the seal protector or seal being movable from a first position, in which at least a portion of the seal is protected by a first end of the seal protector, to a second position, in which the portion of the seal is exposed;

wherein the seal protector comprises a threaded portion, the threaded portion being adapted to engage a corresponding thread on the downhole tubular.

13. A downhole tubular connector comprising a first body portion and a seal provided on the first body portion, the seal being adapted to selectively provide a seal with a downhole tubular, the downhole tubular connector further comprises a seal protector, wherein one of the seal protector and seal is movable with respect to the other of the seal protector and seal, the seal protector or seal being movable from a first position, in which at least a portion of the seal is protected by a first end of the seal protector, to a second position, in which the portion of the seal is exposed;

wherein the downhole tubular connector further comprises a centralising member provided on a distal end of the first body portion, the centralising member being disposed to centralise the downhole tubular connector with respect to a bore of the downhole tubular as the downhole tubular connector is brought into engagement with the downhole tubular.

14. A downhole tubular connector comprising a first body portion and a seal provided on the first body portion, the seal being adapted to selectively provide a seal with a downhole tubular, the downhole tubular connector further comprises a seal protector, wherein one of the seal protector and seal is movable with respect to the other of the seal protector and seal, the seal protector or seal being movable from a first position, in which at least a portion of the seal is protected by a first end of the seal protector, to a second position, in which the portion of the seal is exposed;

wherein the downhole tubular connector further comprises a second body portion in fluid communication with a flow source, the first body portion being selectively extendable with respect to the second body portion, and wherein the downhole tubular connector is arranged such that fluid may selectively flow from the fluid source through the second and first body portions and into the downhole tubular.

15. A method of sealing a downhole tubular connector with a downhole tubular, the method comprising:

providing the downhole tubular connector with a first body portion and a seal provided on the first body portion, the seal being adapted to selectively provide a seal with the downhole tubular;

further providing the downhole tubular connector with a seal protector, wherein one of the seal protector and seal is movable with respect to the other of the seal protector and seal, moving the seal protector or seal from a first position, in which at least a portion of the seal is covered by a first end of the seal protector, to a second position, in which the portion of the seal is exposed;

sealing the seal against the downhole tubular;

providing the downhole tubular connector with a second body portion, the seal protector being connected to the second body portion; and extending the first body portion with respect to the second body portion so as to expose the portion of the seal.

16. The method of sealing a downhole tubular connector with a downhole tubular of claim 15, wherein the method further comprises:

moving the seal protector from the first position to the second position by contact of the seal protector with the downhole tubular as the downhole tubular connector is brought into engagement with the downhole tubular.

17. The method of sealing a downhole tubular connector with a downhole tubular of claim 16, wherein the method further comprises:

biasing the seal protector to the first position.

18. A method of sealing a downhole tubular connector with a downhole tubular, the method comprising:

providing the downhole tubular connector with a first body portion and a seal provided on the first body portion, the seal being adapted to selectively provide a seal with the downhole tubular;

further providing the downhole tubular connector with a seal protector, wherein one of the seal protector and seal is movable with respect to the other of the seal protector and seal, moving the seal protector or seal from a first position, in which at least a portion of the seal is covered by a first end of the seal protector, to a second position, in which the portion of the seal is exposed;

sealing the seal against the downhole tubular;

providing the seal protector with a threaded portion; and engaging the threaded portion with a corresponding thread on the downhole tubular.

19. A method of sealing a downhole tubular connector with a downhole tubular, the method comprising:

providing the downhole tubular connector with a first body portion and a seal provided on the first body portion, the seal being adapted to selectively provide a seal with the downhole tubular;

further providing the downhole tubular connector with a seal protector, wherein one of the seal protector and seal is movable with respect to the other of the seal protector and seal, moving the seal protector or seal from a first position, in which at least a portion of the seal is covered by a first end of the seal protector, to a second position, in which the portion of the seal is exposed;

sealing the seal against the downhole tubular;

providing the downhole tubular connector with a second body portion in fluid communication with a flow source, the first body portion being selectively extendable with respect to the second body portion; and permitting fluid to selectively flow from the fluid source through the second and first body portions and into the downhole tubular.

* * * * *